US008656628B2

(12) United States Patent
Jock et al.

(10) Patent No.: US 8,656,628 B2
(45) Date of Patent: Feb. 25, 2014

(54) SYSTEM, METHOD AND COMPUTER PROGRAM PRODUCT FOR AIMING TARGET

(75) Inventors: Michael Jock, Billerica, MA (US); Scott D. Carpenter, Arlington, MA (US); Mark J. Jasmin, Franklin, MA (US); Kevin J. Grealish, Westwood, MA (US)

(73) Assignee: BAE Systems Information and Electronics Systems Integration Inc., Nashua, NH (US)

( * ) Notice: Subject to any disclaimer, the term of this patent is extended or adjusted under 35 U.S.C. 154(b) by 105 days.

(21) Appl. No.: 13/391,829

(22) PCT Filed: Jun. 21, 2011

(86) PCT No.: PCT/US2011/041141

§ 371 (c)(1),
(2), (4) Date: Feb. 23, 2012

(87) PCT Pub. No.: WO2012/044381

PCT Pub. Date: Apr. 5, 2012

(65) Prior Publication Data

US 2012/0167439 A1 Jul. 5, 2012

Related U.S. Application Data

(60) Provisional application No. 61/357,675, filed on Jun. 23, 2010.

(51) Int. Cl.
*F41G 1/00* (2006.01)

(52) U.S. Cl.
USPC ..... 42/113; 42/130

(58) Field of Classification Search
USPC ..... 42/111–148
See application file for complete search history.

(56) References Cited

U.S. PATENT DOCUMENTS

| | | | |
|---|---|---|---|
| 6,166,744 | A | 12/2000 | Jaszlics et al. |
| 6,295,754 | B1 | 10/2001 | Otteman et al. |
| 6,886,287 | B1 | 5/2005 | Bell et al. |
| 7,051,469 | B1 | 5/2006 | Pochapsky et al. |
| 7,171,776 | B2 | 2/2007 | Staley, III |
| 7,333,270 | B1 | 2/2008 | Pochapsky et al. |
| 2003/0074823 | A1 | 4/2003 | Golan |
| 2007/0044364 | A1 | 3/2007 | Sammut et al. |
| 2008/0039962 | A1 | 2/2008 | McRae |
| 2008/0060248 | A1 | 3/2008 | Pine et al. |

*Primary Examiner* — Samir Abdosh
(74) *Attorney, Agent, or Firm* — Daniel J. Long

(57) ABSTRACT

Disclosed is a system for a weapon sight for aiming a target. The system includes a controller unit configured to initiate an electronic zoom calibration mode, locate a red dot of a day view optic, cause a line of sight to the target unperturbed, electronically superimpose a reticle of the weapon sight onto a thermal image of the target, store information corresponding to a location of the reticle when the reticle is allowed to coincide with the located red dot, and write a pixel corresponding to the stored information of the location of the reticle to a pixel written corresponding to a location of the reticle in a non-electronic zoom mode. The system also includes a memory unit communicably coupled to the controller unit. Further disclosed are a weapon sight and a method for aiming a target using electronic zoom calibration.

11 Claims, 3 Drawing Sheets

SYSTEM, METHOD AND COMPUTER PROGRAM PRODUCT FOR AIMING TARGET

FIELD OF THE DISCLOSURE

The present disclosure generally relates to weapon sights. More particularly, the present disclosure relates to a system, a method and a computer program product for aiming a target using electronic zoom calibration in a weapon sight.

BACKGROUND OF THE DISCLOSURE

When aiming a target with a weapon, such as a shooting weapon, specialized weapon attachments such as a digital imaging weapon sight, a day view optic (direct view optic) and the like, are used. In one form, digital imaging weapon sights are mounted onto shooting weapons (such as guns, rifles, and the like). More specifically, the digital imaging weapon sights are mounted onto the shooting weapons in front of day view optics so that thermal imagery (taken by the digital imaging weapon sights) may be used for aiming targets without either removing the day view optics or zeroing the digital imaging weapon sights. Such an arrangement of the digital imaging weapon sights in front of the day view optics, as mounted onto the shooting weapons, is typically referred to as a clip-on arrangement.

Typically, in a clip-on arrangement, a digital imaging weapon sight is designed to have a unity magnification (i.e., no magnification of a thermal image generated by the digital imaging weapon sight) to ensure that line of sight to a target is not perturbed. Further, the line of sight to the target is taken to be a red dot present in the day view optic. Typically, the red dot, which is an indication feature of the day view optic, is generated by an optical unit, such as a laser, configured within the day view optic, and is projected through the day view optic towards the target being aimed in order to precisely shoot the target.

Further, for shooting the target more precisely, a typical digital imaging weapon sight is provided with an electronic zoom mode. The electronic zoom mode is utilized to magnify a thermal image of a target being aimed. Magnification of the thermal image of the target being aimed enables finer details to be recognized by a user of the shooting weapon that employs the digital imaging weapon sight. However, the magnification of the thermal image of the target being aimed makes the electronic zoom mode incompatible with the clip-on arrangement for targeting purposes.

As an example, FIGS. 1-3 illustrate schematic diagrams for aiming a target using a conventional electronic zoom mode of a digital imaging weapon sight (not shown) that is configured adjacent to a direct view optic (not shown) of a shooting weapon (not shown). In FIG. 1, a thermal image 100 of the target is shown when the conventional electronic zoom mode is not initiated. The thermal image 100, as formed by the digital imaging weapon sight, may be made visible to a user through the direct view optic mounted on the shooting weapon. As further depicted in FIG. 1, the thermal image 100 is shown to include a bullet impact point 110, directly pointing on the target being aimed. Specifically, the bullet impact point 110 is a pictorial representation on the thermal image 100 that signifies a position where a bullet of the shooting weapon will physically impact the target. Furthermore, FIG. 1 depicts a red dot 120 of the direct view optic that falls on the thermal image 100, when the red dot 120 is projected towards the target. For accurate aiming, the red dot 120 needs to be aligned with a reticle of the digital imaging weapon sight.

When the user desires to view finer details of the target, the electronic zoom mode of the digital imaging weapon sight is initiated/activated. The digital imaging weapon sight then tends to magnify (zoom) the thermal image 100 about a physical center 130 of a display of the thermal image 100. FIG. 2 depicts a magnified form of the thermal image 100 of the target being aimed. Thereafter, when the thermal image 100 is viewed through the direct view optic, the alignment of the red dot 120 present on the thermal image 100 is found to be changed with respect to the reticle of the digital imaging weapon sight. Specifically, the alignment of the red dot 120 on the thermal image 100 changes, as the magnification of the thermal image 100 occurs about the physical center 130 of the display of the thermal image 100. Accordingly, when the target is re-aimed, the bullet impact point 110 falls off the magnified thermal image 100, as depicted in FIG. 3. Therefore, magnification of the thermal image 100 of the target being aimed makes the conventional electronic zoom mode incompatible with the clip-on arrangement of the digital imaging weapon sight. Hence, it becomes difficult to aim the target precisely, while using the electronic zoom mode of the digital imaging weapon sight.

Accordingly, there is a need for calibrating an electronic zoom mode of a weapon sight (such as a digital imaging weapon sight), in a manner wherein the electronic zoom mode becomes compatible with the clip-on arrangement of the weapon sight configured in front of a day (direct) view optic mounted on a weapon, while a target is being aimed.

SUMMARY OF THE DISCLOSURE

In view of the foregoing disadvantages inherent in the prior art, the general purpose of the present disclosure is to provide a system, a method and a computer program product for using electronic zoom calibration while aiming a target by a weapon sight, to include all advantages of the prior art, and to overcome the drawbacks inherent in the prior art.

An object of the present disclosure is to employ an electronic zoom calibration mode in a weapon sight, such that the electronic zoom calibration mode is compatible with a clip-on arrangement of the weapon sight configured in front of a day (direct) view optic of a weapon.

Another object of the present disclosure is to employ a reliable and an easy-to-use electronic zoom calibration mode in a weapon sight without perturbing a line of sight while aiming a target.

Another object of the present disclosure is to rectify parallax-induced image misregistration in a thermal (fused) image of a target, as generated by a weapon sight, in a manner that minimizes power consumption and insures appropriate registration of user regions of interest pertaining to the target being aimed.

To achieve the above objects, in an aspect of the present disclosure, a system for a weapon sight for aiming a target is disclosed. The system includes a controller unit configured to initiate an electronic zoom calibration mode. The controller unit is further configured to locate a red dot of a day view optic configured adjacent to the weapon sight. The red dot is located relative to a reticle of the weapon sight. Furthermore, the controller unit is configured to cause a line of sight to the target unperturbed. The line of sight corresponds to the location of the red dot. Also, the controller unit is configured to electronically superimpose the reticle of the weapon sight onto a thermal image of the target. The thermal image is generated by the weapon sight. Furthermore, the controller unit is configured to store information corresponding to a location of the reticle, when the reticle is allowed to coincide with the located red dot. The information is stored prior to exiting the electronic zoom calibration mode. Additionally, the controller unit is configured to write a pixel corresponding to the stored information of the location of the reticle to a pixel written corresponding to a location of the reticle in a non-electronic zoom mode, upon a subsequent initiation of the electronic zoom calibration mode. The system also includes a memory unit communicably coupled to the controller unit, and configured to store the information of the location of the reticle when the reticle is allowed to coincide with the located red dot.

In another aspect, the present disclosure provides a weapon sight for aiming a target. The weapon sight is configured to be used with a day view optic of a weapon. Further, the weapon sight includes an image forming assembly for generating a thermal image of the target. Furthermore, the weapon sight includes a reticle configured to be superimposed onto the thermal image of the target. The weapon sight also includes a controller unit communicably coupled to the image forming assembly and the reticle. The controller unit is configured to initiate an electronic zoom calibration mode. The controller unit is further configured to locate a red dot of the day view optic. The red dot is located relative to the reticle of the weapon sight. The controller unit is also configured to cause a line of sight to the target unperturbed. The line of sight corresponds to the location of the red dot. Additionally, the controller unit is configured to electronically superimpose the reticle of the weapon sight onto the thermal image of the target. Moreover, the controller unit is configured to store information corresponding to a location of the reticle when the reticle is allowed to coincide with the located red dot. The information is stored prior to exiting the electronic zoom calibration mode. In addition, the controller unit is configured to write a pixel corresponding to the stored information of the location of the reticle to a pixel written corresponding to a location of the reticle in a non-electronic zoom mode, upon a subsequent initiation of the electronic zoom calibration mode. The weapon sight also includes a memory unit communicably coupled to the controller unit, and configured to store the information of the location of the reticle when the reticle is allowed to coincide with the located red dot.

In yet another aspect, the present disclosure provides a method for aiming a target using electronic zoom calibration in a weapon sight. The method includes initiating an electronic zoom calibration mode of the weapon sight. The method further includes locating a red dot of a day view optic configured adjacent to the weapon sight. The red dot is located relative to a reticle of the weapon sight. Furthermore, the method includes causing a line of sight to the target unperturbed. The line of sight corresponds to the location of the red dot. Additionally, the method includes electronically superimposing the reticle of the weapon sight onto a thermal image of the target. The thermal image is generated by the weapon sight. Moreover, the method includes translating the reticle to coincide with the located red dot. The located red dot coincided with the reticle is utilized for zooming the thermal image of the target. In addition, the method includes storing information corresponding to a location of the translated reticle prior to exiting the electronic zoom calibration mode. The method also includes writing a pixel corresponding to the stored information of the location of the translated reticle to a pixel written corresponding to a location of the reticle in a non-electronic zoom mode, upon a subsequent initiation of the electronic zoom calibration mode.

In still another aspect, the present disclosure provides a computer program product that includes a computer readable medium having a computer readable program code embodied therein. The computer readable program code includes instructions to be executed by a processor of a computing system for implementing the aforementioned method for aiming a target using electronic zoom calibration.

These together with the other aspects of the present disclosure, along with the various features of novelty that characterize the present disclosure, are pointed out with particularity in the claims annexed hereto and form a part of the present disclosure. For a better understanding of the present disclosure, its operating advantages, and the specified objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of the drawings.

DETAILED DESCRIPTION OF THE DISCLOSURE

The exemplary embodiments described herein in detail for illustrative purposes are subject to many variations in structure and design. It should be emphasized, however, that the present disclosure is not limited to a particular system, a particular method and a particular computer program product for aiming a target, as shown and described. It is understood that various omissions and substitutions of equivalents are contemplated as circumstances may suggest or render expedient, but these are intended to cover the application or embodiments without departing from the spirit or scope of the claims of the present disclosure. Also, it is to be understood that the phraseology and terminology used herein are for the purpose of description and should not be regarded as limiting.

The use of "including," "comprising," or "having" and variations thereof herein is meant to encompass the items listed thereafter and equivalents thereof as well as additional items. Further, the terms, "a" and "an" herein do not denote a limitation of quantity, but rather denote the presence of at least one of the referenced item. Unless limited otherwise, the terms "coupled," and variations thereof herein are used broadly and encompass direct and indirect couplings.

In one aspect, the present disclosure provides a system for a weapon sight for aiming a target. The system includes a controller unit, and a memory unit communicably coupled to the controller unit. The system of the present disclosure is explained in detail in conjunction with FIG. 4.

Figure 1:
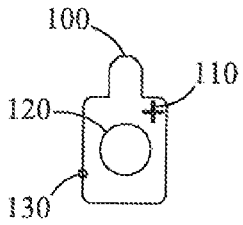
FIG. 1 (Prior art)
FIGS. 1-3 illustrate schematic diagrams for aiming a target using a conventional electronic zoom mode of a digital imaging weapon sight.
Figure 2:
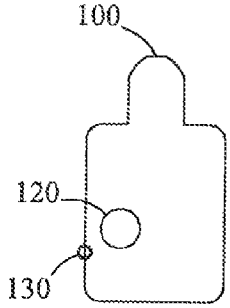
FIG. 2 (Prior art)
Figure 3:
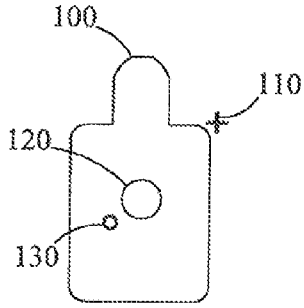
FIG. 3 (Prior art)
Figure 4:
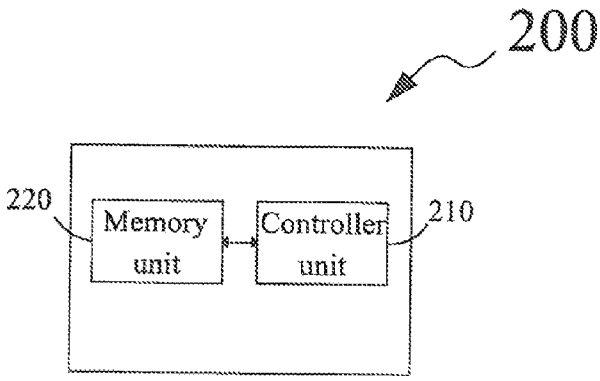
FIG. 4 illustrates a block diagram of a system for a weapon sight for aiming a target, in accordance with an embodiment of the present disclosure.
Figure 5:
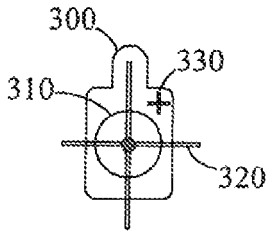
FIGS. 5-6 illustrate schematic diagrams for aiming a target using the system of FIG. 4, in accordance with an embodiment of the present disclosure.

Referring to FIG. 4, a system 200 for a weapon sight, and more specifically, a digital imaging weapon sight (not shown), for aiming a target is provided. The system 200 is configured to be employed in the weapon sight that is used with a weapon (not shown), such as a shooting weapon. Specifically, the weapon sight may be configured in a clip-on arrangement in front of a day view optic (not shown) of the weapon. Further, the weapon sight is configured to generate a thermal image, such as a thermal image 300, of the target while a user (shooter) is aiming the target, as depicted in FIG. 5. It is to be understood that the thermal image 300 of the target being aimed may be generated by an image forming assembly of the weapon sight. The image forming assembly of the weapon sight may include components, such as one or more lens, and the like, as known in the art, for generating the thermal image 300. Further, the thermal image 300 may be viewed through the day view optic configured adjacent to the weapon sight.

Referring again to FIG. 4, the system 200 includes a controller unit 210. The controller unit 210 is configured to process a set of instructions and is in the form of a microcontroller with processing capabilities. Specifically, the controller unit 210 is configured to initiate an electronic zoom calibration mode in the weapon sight. Further, the controller unit 210 is configured to locate a red dot, such as a red dot 310, of the day view optic configured adjacent to the weapon sight, as depicted in FIG. 5. The red dot 310 of the day view optic is located relative to the weapon sight, and more specifically, to a reticle, such as a reticle 320, of the weapon sight.

It is to be understood that the red dot 310 is aligned to the target that is aimed by the weapon sight, and is provided as an indication feature by the day view optic mounted on the weapon to facilitate the user of the weapon to more accurately aim the target. Further; the red dot 310 may be generated by an optical unit (not shown), such as a laser assembly, which is configured within the day view optic. Additionally, the shape and size of the red dot 310, as depicted in FIG. 5, should not be considered as a limitation to the present disclosure. It should also be understood that any other type of indication feature, i.e., other than the red dot 310, may be used for the purpose of the present disclosure.

Further, the reticle 320 of the weapon sight may be generated by an internal electronic unit (not shown) of the weapon sight. The reticle 320 may be an electronically programmable aim-reticle that may be laid on an eyepiece display (not shown) of the weapon sight that also depicts/displays the thermal image 300 to the user. Thus, the reticle 320 facilitates the user to accurately locate the target so that a line of sight to the target is established in order to shoot the target being located without any error. The line of sight corresponds to the location of the red dot 310, as determined by the controller unit 210.

The controller unit 210 is further configured to cause the line of sight to the target unperturbed by appropriately locating the red dot 310 relative to the reticle 320 of the weapon sight. The controller unit 210 is also configured to electronically superimpose the reticle 320 of the weapon sight onto the thermal image 300 of the target being aimed, as depicted in FIG. 5. The thermal image 300 is also shown to include a bullet impact point 330, which is a pictorial representation on the thermal image 300 that signifies a position where a bullet of the weapon will physically impact the target.

Figure 6:
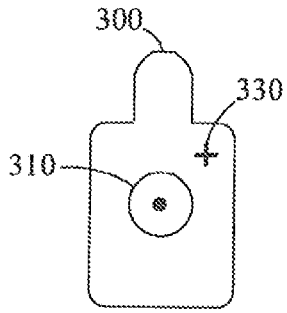

As depicted in FIG. 5, the reticle 320 of the weapon sight is then allowed to coincide with the located red dot 310 of the day view optic. Specifically, the weapon sight may be provided with a plurality of switch controls to manually adjust the position of the reticle 320 in order to coincide the reticle 320 with the located red dot 310. The located red dot 310 of the day view optic coincided with the reticle 320 of the weapon sight is utilized by the controller unit 210 for zooming the thermal image 300 of the target. More specifically, the located red dot 310 of the day view optic is utilized by the controller unit 210 as a center of a zoom operation, thereby, eliminating any need to re-aim the target. Further, zooming of the thermal image 300 while considering the red dot 310 being a point of reference assists the weapon sight to function appropriately using a calibrated electronic zoom mode (i.e., electronic zoom calibration mode). Accordingly, the bullet impact point 330 remains unperturbed as shown in a magnified form of the thermal image 300 when viewed through the day view optic, in FIG. 6. As depicted in FIG. 6, the bullet impact point 330 remains unchanged after the zooming operation has been performed, thereby, aiding in precisely aiming the target.

The controller unit 210 is further configured to store information corresponding to the location of the reticle 320 when coincided with the located red dot 310, prior to exiting the electronic zoom calibration mode. The stored information corresponding to the location of the reticle 320 when coincided with the located red dot 310 is then utilized when an electronic zoom calibration mode is re-initiated, i.e., during a subsequent initiation of the electronic zoom calibration mode. It should be understood that a thermal image, such as the thermal image 300, as generated by any weapon sight is an image displayed with reference to a plurality of addressable pixels, as known in the art. Accordingly, the stored information corresponding to the location of the reticle 320 when coincided with the located red dot 310 corresponds to such a plurality of addressable pixels.

The controller unit 210 is also configured to write a pixel (not shown) of the plurality of addressable pixels corresponding to the stored information of the location the reticle 320 coincided with the located red dot 310, to a pixel of the plurality of addressable pixels written corresponding to a location of the reticle 320 in a non-electronic zoom mode, upon a subsequent initiation of the electronic zoom calibration mode. Such a functionality of the controller unit 210 aids in averting any change in the position of the bullet impact point 330 even after magnification of the thermal image 300.

Referring again to FIG. 4, the system 200 for the weapon sight also includes a memory unit 220 communicably coupled (through either a wireless or a wired connection) to the controller unit 210. The memory unit 220 is configured to store information of the location of the reticle 320 when coincided with the located red dot 310. The memory unit 220 may include volatile and non-volatile type of memory.

Figure 7:
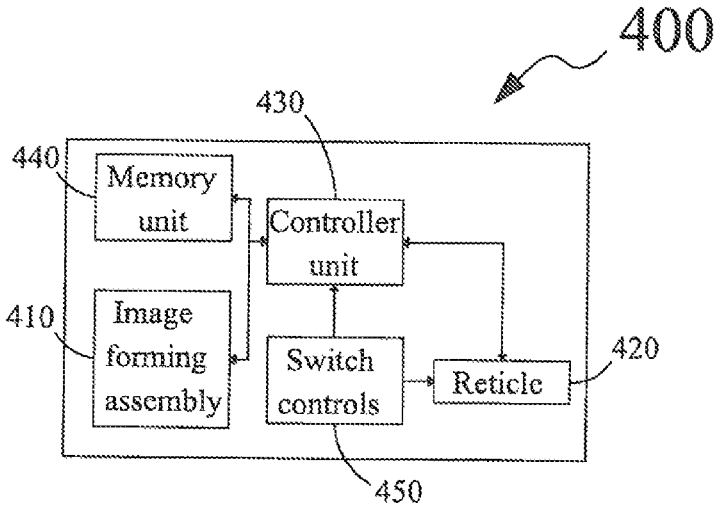
FIG. 7 illustrates a block diagram of a weapon sight for aiming a target, in accordance with an embodiment of the present disclosure.

In another aspect, the present disclosure provides a weapon sight 400 for aiming a target as depicted in FIG. 7. The weapon sight 400 is further configured to be used with a day view optic (not shown) of a weapon, such as a shooting weapon. The weapon sight 400 is a digital imaging weapon sight that includes an image forming assembly 410 for generating a thermal image (such as the thermal image 300 of FIG. 5) of the target being aimed. The image forming assembly 410 of the weapon sight 400 may include components, such as one or more lens, and the like, as known in the art, for generating the thermal image. Further, the thermal image as generated by the image forming assembly 410 may be viewed through the day view optic configured adjacent to the weapon sight 400. Also, the thermal image forming assembly 410 is capable of generating the thermal image having one of a unity magnification and a non-unity magnification.

Referring to FIG. 7, the weapon sight 400 also includes a reticle 420. The reticle 420 is configured to be superimposed onto the thermal image of the target. The reticle 420 is shown as a block in FIG. 7 for the sake of clarity. However, when the reticle 420 is superimposed onto the thermal image of the target, then the reticle 420 may be viewed as an intersection of two perpendicular lines. It is to be understood that the structure and shape of the reticle 420, as defined herein above, should not be considered as a limitation to the present disclosure. Further, the reticle 420 is structurally and functionally similar to the reticle 320, and accordingly, the description of the reticle 420 is avoided herein for the sake of brevity.

The weapon sight 400 further includes a controller unit 430. The controller unit 430 is communicably coupled (through either a wireless or a wired connection) to the image forming assembly 410 and the reticle 420. The controller unit 430 is structurally and functionally similar to the controller unit 210 of the system 200 of FIG. 4, and is configured to initiate an electronic zoom calibration mode, to locate a red dot (such as the red dot 310) of the day view optic, to cause a line of sight to the target unperturbed, to electronically superimpose the reticle 420 of the weapon sight 400 onto the thermal image of the target, to store information corresponding to a location of the reticle 420 when the reticle 420 is allowed to coincide with the located red dot, and to write a pixel corresponding to the stored information of the location of the reticle 420 to a pixel written corresponding to a location of the reticle 420 in a non-electronic zoom mode, upon a subsequent initiation of the electronic zoom calibration mode. Therefore, a detailed description of the controller unit 430 is avoided herein for the sake of brevity. Further, it is to be understood that the red dot is aligned to the target that is aimed by the weapon sight 400.

Referring again to FIG. 7, the weapon sight 400 also includes a memory unit 440. The memory unit 440 is communicably coupled (through either a wireless or a wired connection) to the controller unit 430. Further, the memory unit 440 is configured to store the information of the location of the reticle 420 when coincided with the located red dot. The memory unit 440 is structurally and functionally similar to the memory unit 220 of the system 200, therefore a detailed description of the memory unit 440 is avoided herein for the sake of brevity.

The weapon sight 400 further includes a plurality of switch controls 450, which are shown in the form of a block in FIG. 7 for the purpose of clarity. The switch controls 450 are communicably coupled (through either a wireless or a wired connection) with the reticle 420, and are mounted on the weapon sight 400 for manually adjusting a position of the reticle 420 upon the thermal image of the target being aimed and to coincide the reticle 420 with the located red dot. More specifically, the switch controls 450 are utilized to locate the reticle 420 in two dimensions and activate the located reticle 420. The switch controls 450 may include five dedicated switch buttons, such as 'LEFT', 'RIGHT', 'UP', 'DOWN' and 'ACTIVATE' switch buttons to locate and activate the reticle 420.

Alternatively, the switch controls 450 may include two 'PRESS and HOLD' switch buttons for activation of the reticle 420. The 'LEFT', 'RIGHT', 'UP', and 'DOWN' operations may be performed using the same two 'PRESS and HOLD' switch buttons by implementing a double press for the respective operations. It will be understood that the switch controls 450 are communicably coupled (through either a wireless or a wired connection) with the controller unit 430 that controls/processes the functionality of the weapon sight 400. Further, a user may utilize the switch controls 450 in order to command the controller unit 430 to initiate/activate the electronic zoom calibration mode for magnifying the thermal image without perturbing the line of sight and while averting any need for re-aiming the target.

Figure 8:
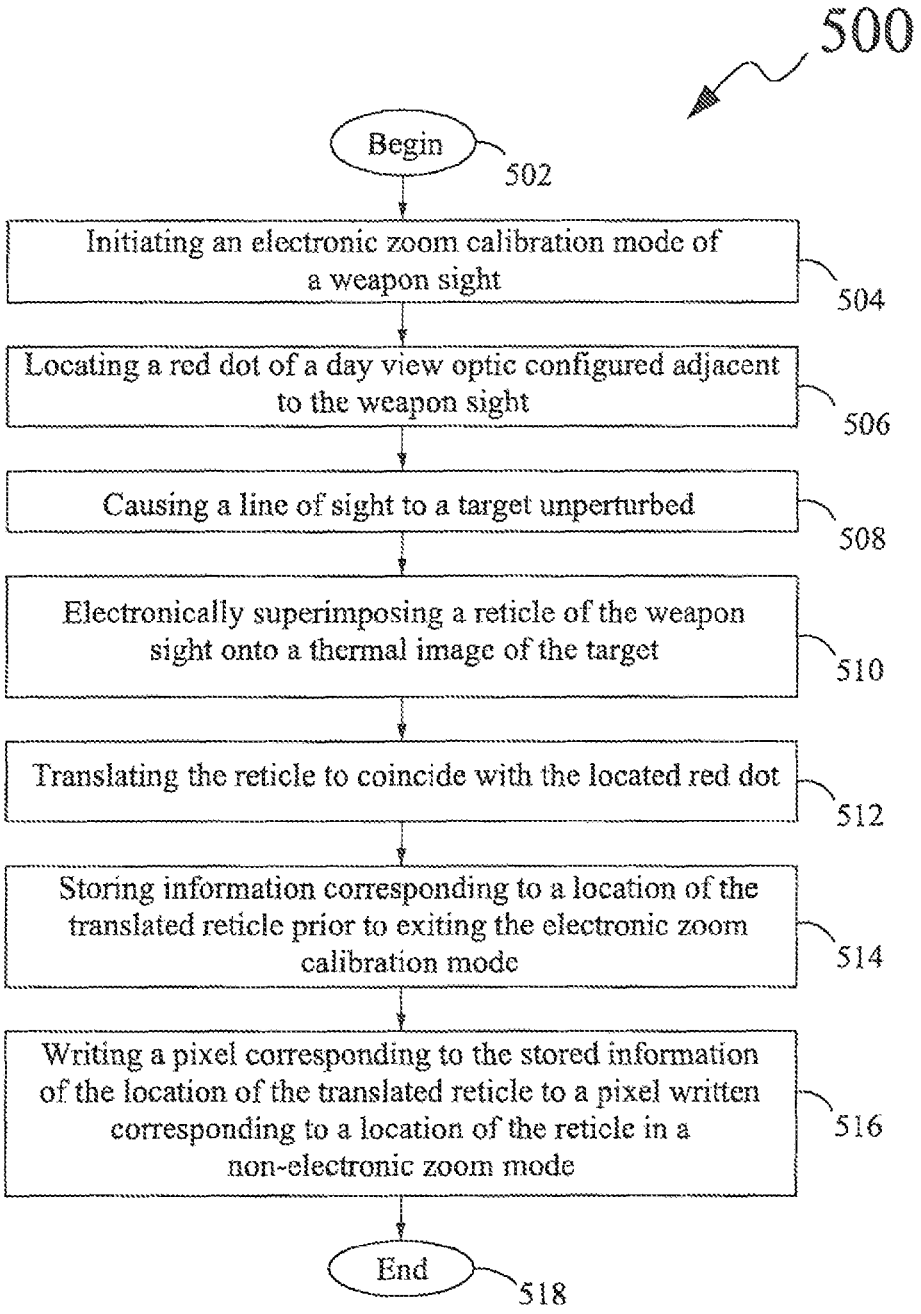
FIG. 8 illustrates a flow diagram for a method for aiming a target using electronic zoom calibration in a weapon sight, in accordance with an embodiment of the present disclosure.

In yet another aspect, the present disclosure provides a method 500 for aiming a target using electronic zoom calibration in a weapon sight (such as the weapon sight 400 of FIG. 7), as depicted in FIG. 8. References will be made to the weapon sight 400 of FIG. 7 and the system 200 of FIG. 4, to explain the method 500. The method 500 begins at 502. At 504, the electronic zoom calibration mode is initiated, by a controller unit, such as the controller units 210 and 430. At 506, a red dot, such as the red dot 310, of a day view optic configured adjacent to the weapon sight, is located by the controller unit. Further, the location of the red dot is relative to a reticle (such as the reticles 320 and 420) of the weapon sight. At 508, the controller unit causes a line of sight to the target that corresponds to the located red dot, to remain unperturbed.

At 510, the reticle of the weapon sight is electronically superimposed onto a thermal image of the target, by the controller unit. The thermal image of the target is generated by the weapon sight, and more specifically, by an image forming assembly (such as the image forming assembly 410) of the weapon sight. At 512, the reticle is translated to coincide with the located red dot, by a user. Specifically, the user may utilize a plurality of switch controls, such as the switch controls 450, for adjusting/moving the reticle to coincide with the located red dot. Further, the located red dot coincided with the reticle is utilized for zooming the thermal image of the target, by the controller unit. At 514, information corresponding to the location of the translated reticle is stored by the controller unit in a memory unit, such as the memory units 220 and 440, prior to exiting the electronic zoom calibration mode. At 516, a pixel corresponding to the stored information of the location of the translated reticle is written to a pixel written corresponding to a location of the reticle in a non-electronic zoom mode, upon a subsequent initiation of the electronic zoom calibration mode. The method ends at 518.

In still another aspect, the present disclosure provides a computer program product that includes a computer readable medium having a computer readable program code embodied therein. The computer readable program code includes instructions to be executed by a processor of a computing system for implementing the method 500 for aiming a target using electronic zoom calibration in a weapon sight.

It will also be apparent to a person skilled in the art that the present disclosure as described above, may also be simply embodied in the form of computer program code, for example, whether stored in a storage medium, loaded into and/or executed by a weapon sight, or transmitted over some transmission medium, such as over electrical wiring or cabling, through fiber optics, or via electromagnetic radiation, wherein, when the computer program code is loaded into and executed by a weapon sight, the weapon sight becomes a device/an apparatus for practicing the present disclosure. When implemented on a general-purpose microprocessor, the computer program code segments configure the microprocessor to be executed by specific logic circuits present in the microprocessor. Thus, any clip-on type weapon sight may be upgraded with the present disclosure to achieve electronic zoom calibration. Accordingly, the present disclosure may be translated into a software language/code used by existing weapon sights and may be loaded through an interface (such as a port for a Universal Serial Bus) that the weapon sights may be equipped with.

The present disclosure provides an effective system, such as the system 200, for a weapon sight (such as a digital imaging weapon sight) of a weapon, for aiming a target. Further, the system is adapted to calibrate an electronic zoom mode of the weapon sight, such that the functionality of the electronic zoom mode becomes compatible with the clip-on arrangement in which the weapon sight is being provided, while the target is aimed. In another aspect, the present disclosure provides an effective weapon sight (such as the weapon sight 400) for aiming a target using a weapon. The weapon sight provides for electronic zoom calibration while aiming the target, to locate a red dot in a day view optic of the weapon relative to a reticle of the weapon sight. In addition, the present disclosure provides a method, such as the method 500, which is a reliable and an easy-to-use method for utilizing electronic zoom calibration in the weapon sight while a target is being aimed.

Based on the aforementioned, the present disclosure assists in rectifying parallax-induced image misregistration in a thermal (fused) image by storing relevant information corresponding to a location of a translated reticle (of a weapon sight) coincided with a red dot of a day view optic of a weapon, prior to exiting an electronic zoom calibration mode; and using the stored information for writing a pixel to the same display pixel that it is written to in a non-electronic zoom mode while all of the other pixels are mapped accordingly. Therefore, the present disclosure assists in minimizing power consumption and insures that user regions of interest pertaining to a target being aimed are always well-registered/stored for an appropriate target attempt, while using the optics focus (red dot of the day view optics) adjustment as a means to estimate range and develop the appropriate correction factors for a precise aiming of the target.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A system for a weapon sight for aiming a target, the system comprising:

a controller unit configured to, initiate an electronic zoom calibration mode, locate a red dot of a day view optic configured adjacent to the weapon sight, the red dot being located relative to a reticle of the weapon sight, cause a line of sight to the target unperturbed, wherein the line of sight corresponds to the location of the red dot, electronically superimpose the reticle of the weapon sight onto a thermal image of the target, wherein the thermal image is generated by the weapon sight, store information corresponding to a location of the reticle when allowed to coincide with the located red dot, the information being stored prior to exiting the electronic zoom calibration mode, and write a pixel corresponding to the stored information of the location of the reticle to a pixel written corresponding to a location of the reticle in a non-electronic zoom mode, upon a subsequent initiation of the electronic zoom calibration mode; and a memory unit communicably coupled to the controller unit, the memory unit being configured to store the information of the location of the reticle when allowed to coincide with the located red dot.

2. The system of claim 1, wherein the controller unit is further configured to utilize the located red dot as a center of a zoom operation.

3. A weapon sight for aiming a target, the weapon sight configured to be used with a day view optic of a weapon, the weapon sight comprising:

an image forming assembly for generating a thermal image of the target;

a reticle configured to be superimposed onto the thermal image of the target;

a controller unit communicably coupled to the image forming assembly and the reticle, the controller unit being configured to, initiate an electronic zoom calibration mode, locate a red dot of the day view optic, the red dot being located relative to the reticle of the weapon sight, cause a line of sight to the target unperturbed, wherein the line of sight corresponds to the location of the red dot, electronically superimpose the reticle of the weapon sight onto the thermal image of the target, store information corresponding to a location of the reticle when allowed to coincide with the located red dot, the information being stored prior to exiting the electronic zoom calibration mode, and write a pixel corresponding to the stored information of the location of the reticle to a pixel written corresponding to a location of the reticle in a non-electronic zoom mode, upon a subsequent initiation of the electronic zoom calibration mode; and a memory unit communicably coupled to the controller unit, the memory unit being configured to store the information of the location of the reticle when allowed to coincide with the located red dot.

4. The weapon sight of claim 3, wherein the controller unit is further configured to utilize the located red dot as a center of a zoom operation.

5. The weapon sight of claim 3, further comprising a plurality of switch controls mounted on the weapon sight for manually adjusting the position of the reticle upon the thermal image of the target for superimposition, and for coinciding the reticle with the located red dot.

6. The weapon sight of claim 3, wherein the thermal image is having one of a unity magnification and a non-unity magnification.

7. The weapon sight of claim 3, wherein the red dot of the day view optic is aligned to the target being aimed by the weapon sight.

8. A method for aiming a target using electronic zoom calibration in a weapon sight, the method comprising:

initiating an electronic zoom calibration mode of the weapon sight;

locating a red dot of a day view optic configured adjacent to the weapon sight, the red dot being located relative to a reticle of the weapon sight;

causing a line of sight to the target unperturbed, wherein the line of sight corresponds to the location of the red dot;

electronically superimposing the reticle of the weapon sight onto a thermal image of the target, wherein the thermal image is generated by the weapon sight;

translating the reticle to coincide with the located red dot, the located red dot coincided with the reticle being utilized for zooming the thermal image of the target;

storing information corresponding to a location of the translated reticle prior to exiting the electronic zoom calibration mode; and writing a pixel corresponding to the stored information of the location of the translated reticle to a pixel written corresponding to a location of the reticle in a non-electronic zoom mode, upon a subsequent initiation of the electronic zoom calibration mode.

9. The method of claim 8, wherein the located red dot is utilized as a center of a zoom operation.

10. The method of claim 8, wherein the red dot is aligned to the target being aimed by the weapon sight.

11. A computer program product comprising a computer readable medium having a computer readable program code embodied therein, the computer readable program code containing instructions to be executed by a processor of a computing system for implementing a method for aiming a target using electronic zoom calibration in a weapon sight, wherein the method comprises:

initiating an electronic zoom calibration mode of the weapon sight;

locating a red dot of a day view optic configured adjacent to the weapon sight, the red dot being located relative to a reticle of the weapon sight;

causing a line of sight to the target unperturbed, wherein the line of sight corresponds to the location of the red dot;

electronically superimposing the reticle of the weapon sight onto a thermal image of the target, wherein the thermal image is generated by the weapon sight;

translating the reticle to coincide with the located red dot, the located red dot coincided with the reticle being utilized for zooming the thermal image of the target;

storing information corresponding to the location of the translated reticle prior to exiting the electronic zoom calibration mode; and writing a pixel corresponding to the stored information of the location of the translated reticle to a pixel written corresponding to a location of the reticle in a non-electronic zoom mode, upon a subsequent initiation of the electronic zoom calibration mode.

* * * * *